US007770305B1

(12) United States Patent
Krauss

(10) Patent No.: US 7,770,305 B1
(45) Date of Patent: Aug. 10, 2010

(54) CLOTHES DRYING APPARATUS

(76) Inventor: Leonard Krauss, 955 Terra California Dr., #5, Walnut Creek, CA (US) 94595

( * ) Notice: Subject to any disclaimer, the term of this patent is extended or adjusted under 35 U.S.C. 154(b) by 353 days.

(21) Appl. No.: 11/724,142

(22) Filed: Mar. 14, 2007

(51) Int. Cl.
*F26B 19/00* (2006.01)

(52) U.S. Cl. ..... 34/60; 34/90; 34/103; 34/201; 34/212; 34/239; 312/31; 312/249.8; 223/67; 223/88; 211/104; 211/113

(58) Field of Classification Search ..... 34/60, 34/90, 103, 104, 201, 202, 212, 239; 312/31, 312/249.8; 223/67, 88; 211/104, 113
See application file for complete search history.

(56) References Cited

U.S. PATENT DOCUMENTS 1,895,323 A * 1/1933 Hauf ..... 108/91
2,060,395 A 11/1936 Irwin et al.
2,108,308 A 2/1938 Dickey
2,117,656 A 5/1938 Donnellan
2,120,436 A * 6/1938 Fallot ..... 211/118
2,501,167 A 3/1950 Frost
2,539,895 A 1/1951 Cuneo et al.
2,777,618 A 1/1957 Wilklow
2,815,157 A * 12/1957 Badgley ..... 223/66
2,880,928 A 4/1959 Merrill
2,902,192 A 9/1959 Ericson et al.
2,929,538 A 3/1960 Douglass
2,937,796 A 5/1960 Donahue
2,958,447 A 11/1960 Rouseau
3,166,198 A * 1/1965 Gingher ..... 211/123
3,175,696 A * 3/1965 Milbourne ..... 211/119.004
3,184,127 A * 5/1965 Smith ..... 223/67
3,280,477 A * 10/1966 Rawlins ..... 34/622
3,464,604 A * 9/1969 Chezum ..... 223/69
3,477,155 A 11/1969 Feld et al.
3,486,669 A 12/1969 George et al.
3,576,079 A * 4/1971 Hauser ..... 34/542
3,601,292 A * 8/1971 Bliss ..... 68/6
3,645,425 A 2/1972 Witzke
3,675,338 A 7/1972 Maki
3,686,899 A * 8/1972 Rosenfeld et al. ..... 38/3 R
3,750,917 A * 8/1973 Villani ..... 223/74
3,781,921 A * 1/1974 Rouat ..... 4/532
3,811,198 A * 5/1974 Baltes ..... 34/466
3,833,127 A * 9/1974 Schoen et al. ..... 211/119.008
4,029,239 A * 6/1977 Dolan ..... 223/85
4,081,975 A * 4/1978 Wortham et al. ..... 68/18 FA
4,086,709 A * 5/1978 Jackson ..... 34/90
4,094,076 A * 6/1978 Baslow ..... 34/90
4,142,719 A * 3/1979 Blood ..... 473/386
4,157,776 A * 6/1979 Dolan ..... 223/92
4,180,919 A * 1/1980 Baltes ..... 34/449
4,257,173 A * 3/1981 Smith ..... 34/92
4,303,183 A * 12/1981 Schlemon ..... 223/67
4,403,425 A * 9/1983 Mussiger ..... 34/661
4,429,928 A * 2/1984 Sullivan ..... 312/31
4,434,897 A * 3/1984 Gelhaus ..... 211/1.3
4,538,365 A * 9/1985 Aho ..... 34/239

(Continued)

*Primary Examiner*—Stephen M. Gravini
(74) *Attorney, Agent, or Firm*—Thomas R. Lampe

(57) ABSTRACT

A portable collapsible clothes dryer kit including two clothing article dryer units for engaging and spreading different articles of clothing, one of the units being supported by spaced, elongated flexible elements and the other of the units being supported by a coat hanger.

14 Claims, 3 Drawing Sheets

U.S. PATENT DOCUMENTS

| | | | | |
|---|---|---|---|---|
| 4,564,963 | A * | 1/1986 | Bergmark | 4/597 |
| 4,572,364 | A * | 2/1986 | Jordan | 206/287 |
| 4,574,961 | A * | 3/1986 | Keiels et al. | 211/119.01 |
| 4,583,649 | A * | 4/1986 | Brown | 211/183 |
| 4,613,066 | A | 9/1986 | Saucy | |
| 4,682,424 | A * | 7/1987 | Irving | 34/621 |
| 4,697,357 | A * | 10/1987 | Van Vliet | 34/611 |
| 4,724,969 | A * | 2/1988 | Steiner | 211/197 |
| 4,735,326 | A * | 4/1988 | Steiner | 211/197 |
| 4,761,305 | A * | 8/1988 | Ochiai | 427/180 |
| 4,761,896 | A * | 8/1988 | Miyata | 34/77 |
| 4,768,657 | A * | 9/1988 | Lonow | 211/34 |
| 4,819,341 | A * | 4/1989 | Gayso | 34/86 |
| 4,819,812 | A * | 4/1989 | Demarest, Jr. | 211/1.3 |
| 4,830,202 | A * | 5/1989 | Steiner | 211/197 |
| 4,869,872 | A * | 9/1989 | Baltes | 422/1 |
| 4,873,773 | A * | 10/1989 | Canonge | 34/90 |
| 4,874,100 | A * | 10/1989 | Smagula | 211/60.1 |
| 4,901,871 | A * | 2/1990 | Ohm et al. | 211/119.004 |
| 4,915,271 | A * | 4/1990 | Champagne | 223/69 |
| 4,930,579 | A * | 6/1990 | George | 169/54 |
| 4,934,559 | A * | 6/1990 | Putnam | 220/377 |
| 4,949,842 | A * | 8/1990 | Mokiao, II | 206/286 |
| 4,958,594 | A * | 9/1990 | Swagerty | 119/400 |
| 5,036,560 | A * | 8/1991 | Inghirami | 8/149.1 |
| 5,044,507 | A * | 9/1991 | Shulyak | 211/203 |
| 5,050,760 | A * | 9/1991 | Garcia | 220/751 |
| 5,090,559 | A * | 2/1992 | Gendreau | 206/278 |
| 5,163,590 | A | 11/1992 | Lawler et al. | |
| 5,219,080 | A * | 6/1993 | Reyes | 211/196 |
| 5,253,775 | A * | 10/1993 | Gould | 220/23.83 |
| 5,332,109 | A * | 7/1994 | Johnson | 211/96 |
| 5,361,516 | A * | 11/1994 | Dahman | 34/440 |
| 5,369,893 | A * | 12/1994 | Perito | 34/239 |
| 5,375,727 | A * | 12/1994 | Lavi | 211/119.01 |
| 5,381,588 | A * | 1/1995 | Nelson | 24/30.5 S |
| 5,394,619 | A * | 3/1995 | Kaplan | 34/90 |
| 5,394,621 | A | 3/1995 | Levy | |
| 5,437,106 | A * | 8/1995 | Pardoe | 34/90 |
| 5,458,249 | A * | 10/1995 | Shang-Lu | 211/197 |
| 5,547,271 | A * | 8/1996 | Rydell | 312/211 |
| 5,555,648 | A * | 9/1996 | Griffin | 34/621 |
| 5,607,088 | A | 3/1997 | Carranza | |
| 5,729,909 | A * | 3/1998 | Chesnutt Robison | 34/109 |
| 5,809,828 | A * | 9/1998 | Gardell et al. | 73/865.9 |
| 5,815,944 | A * | 10/1998 | Palmer | 34/202 |
| 5,815,961 | A * | 10/1998 | Estes et al. | 38/14 |
| 5,829,162 | A * | 11/1998 | Pace | 34/202 |
| 5,950,882 | A | 9/1999 | Scott | |
| 6,041,517 | A * | 3/2000 | Wang | 34/439 |
| 6,047,482 | A * | 4/2000 | Roper | 34/106 |
| 6,067,723 | A * | 5/2000 | Lafrenz | 34/61 |
| 6,153,862 | A * | 11/2000 | Job | 219/521 |
| 6,185,834 | B1 * | 2/2001 | Yang | 34/58 |
| 6,193,034 | B1 * | 2/2001 | Fournier | 190/107 |
| 6,224,259 | B1 * | 5/2001 | Guerra | 383/24 |
| 6,257,424 | B1 * | 7/2001 | Miller | 211/87.01 |
| 6,327,994 | B1 * | 12/2001 | Labrador | 114/382 |
| 6,330,969 | B1 * | 12/2001 | Villaraut | 235/64.7 |
| 6,363,627 | B1 * | 4/2002 | Lai | 34/621 |
| 6,385,862 | B1 * | 5/2002 | Vande Haar | 34/441 |
| 6,398,410 | B1 * | 6/2002 | Guerra | 383/24 |
| 6,622,529 | B1 * | 9/2003 | Crane | 68/5 C |
| D487,357 | S * | 3/2004 | Holt | D6/326 |
| 6,742,309 | B2 * | 6/2004 | Stewart et al. | 52/79.5 |
| 6,745,496 | B2 * | 6/2004 | Cassella | 34/621 |
| 6,766,670 | B2 * | 7/2004 | Estes et al. | 68/5 C |
| 6,796,055 | B2 * | 9/2004 | Baltes | 34/449 |
| 6,880,711 | B2 * | 4/2005 | Collier | 211/85.7 |
| 6,922,911 | B2 | 8/2005 | Lam | |
| 6,922,913 | B2 * | 8/2005 | Hood et al. | 34/595 |
| 6,928,752 | B2 * | 8/2005 | Johnson et al. | 34/595 |
| 6,954,992 | B2 * | 10/2005 | Hwang | 34/108 |
| 6,973,740 | B2 * | 12/2005 | Meyer | 34/224 |
| 7,089,768 | B2 * | 8/2006 | Bolduan et al. | 68/5 C |
| 7,097,051 | B2 * | 8/2006 | Schober et al. | 211/123 |
| 7,137,211 | B2 * | 11/2006 | Johnson et al. | 34/381 |
| 7,159,910 | B2 * | 1/2007 | Hwang | 292/341.15 |
| 7,185,801 | B2 * | 3/2007 | Session, Sr. | 232/1 B |
| 7,191,546 | B2 * | 3/2007 | Maruca | 34/201 |
| 7,246,730 | B2 * | 7/2007 | Russo | 223/85 |
| 7,273,831 | B1 * | 9/2007 | Fleskes et al. | 504/115 |
| 7,305,856 | B2 * | 12/2007 | Bolduan et al. | 68/5 C |
| 7,322,127 | B2 * | 1/2008 | Hwang | 34/603 |
| 7,377,052 | B2 * | 5/2008 | Maruca | 34/201 |
| 7,455,202 | B2 * | 11/2008 | Shimura | 223/89 |
| 2002/0017117 | A1 * | 2/2002 | Sunshine et al. | 68/3 R |
| 2002/0079477 | A1 * | 6/2002 | Kelley et al. | 252/8.81 |
| 2002/0133969 | A1 * | 9/2002 | Cassella | 34/201 |
| 2003/0017957 | A1 * | 1/2003 | Fox et al. | 510/407 |
| 2003/0019798 | A1 * | 1/2003 | Capps et al. | 209/630 |
| 2003/0037812 | A1 * | 2/2003 | Stewart et al. | 135/96 |
| 2003/0074105 | A1 * | 4/2003 | Capps et al. | 700/225 |
| 2003/0079267 | A1 * | 5/2003 | Dugan | 2/69 |
| 2003/0116226 | A1 * | 6/2003 | Muncada | 144/329 |
| 2003/0222038 | A1 * | 12/2003 | Collier | 211/85.7 |
| 2004/0000174 | A1 * | 1/2004 | Bolduan et al. | 68/5 D |
| 2004/0000175 | A1 * | 1/2004 | Bolduan et al. | 68/5 D |
| 2004/0004206 | A1 * | 1/2004 | Kelley et al. | 252/8.91 |
| 2004/0041290 | A1 * | 3/2004 | Barich | 264/28 |
| 2004/0074858 | A1 * | 4/2004 | Thuma et al. | 211/202 |
| 2004/0107598 | A1 * | 6/2004 | Hwang | 34/601 |
| 2004/0111916 | A1 * | 6/2004 | Hwang | 34/601 |
| 2004/0112095 | A1 * | 6/2004 | Bolduan et al. | 68/5 C |
| 2004/0134087 | A1 * | 7/2004 | Meyer | 34/90 |
| 2004/0134237 | A1 * | 7/2004 | Sunshine et al. | 68/3 R |
| 2004/0194339 | A1 * | 10/2004 | Johnson et al. | 34/595 |
| 2005/0005533 | A1 * | 1/2005 | Stewart et al. | 52/79.1 |
| 2005/0050762 | A1 * | 3/2005 | Hood et al. | 34/595 |
| 2005/0092033 | A1 * | 5/2005 | Luckman et al. | 68/124 |
| 2005/0098759 | A1 * | 5/2005 | Frankenbach et al. | 252/8.91 |
| 2005/0155997 | A1 * | 7/2005 | O'Donnell | 224/257 |
| 2005/0224532 | A1 * | 10/2005 | Russo | 223/85 |
| 2005/0278972 | A1 * | 12/2005 | Maruca | 34/201 |
| 2006/0009582 | A1 * | 1/2006 | Zhang et al. | 525/178 |
| 2006/0022419 | A1 * | 2/2006 | Phillips, II | 280/47.35 |
| 2006/0037209 | A1 * | 2/2006 | Johnson et al. | 34/90 |
| 2006/0041479 | A1 * | 2/2006 | Nesky et al. | 705/14 |
| 2006/0042114 | A1 * | 3/2006 | Robson et al. | 34/90 |
| 2006/0054576 | A1 * | 3/2006 | Durham | 211/85.7 |
| 2006/0090524 | A1 * | 5/2006 | Jeon et al. | 68/135 |
| 2006/0112737 | A1 * | 6/2006 | Sunshine et al. | 68/3 R |
| 2006/0137205 | A1 * | 6/2006 | Lee et al. | 34/60 |
| 2006/0137206 | A1 * | 6/2006 | Lee et al. | 34/86 |
| 2006/0138061 | A1 * | 6/2006 | Thipchuwong et al. | 211/1.54 |
| 2006/0143076 | A1 * | 6/2006 | Stafford | 705/14 |
| 2006/0156765 | A1 * | 7/2006 | Sunshine et al. | 68/13 R |
| 2006/0213963 | A1 * | 9/2006 | Session, Sr. | 232/1 B |
| 2007/0012638 | A1 * | 1/2007 | Van Eijk | 211/104 |
| 2007/0028854 | A1 * | 2/2007 | Chern | 119/753 |
| 2007/0089317 | A1 * | 4/2007 | Crawford et al. | 34/237 |
| 2007/0130684 | A1 * | 6/2007 | Watts | 4/596 |
| 2007/0144032 | A1 * | 6/2007 | Maruca | 34/469 |
| 2007/0151300 | A1 * | 7/2007 | Sunshine | 68/3 R |
| 2007/0151301 | A1 * | 7/2007 | Kendall et al. | 68/3 R |
| 2007/0151302 | A1 * | 7/2007 | Kendall et al. | 68/3 R |
| 2007/0151305 | A1 * | 7/2007 | Kendall et al. | 68/13 R |
| 2007/0151309 | A1 * | 7/2007 | Kendall et al. | 68/235 R |
| 2007/0151312 | A1 * | 7/2007 | Bruce et al. | 68/3 R |
| 2007/0151575 | A1 * | 7/2007 | De Masi | 132/309 |
| 2007/0205173 | A1 * | 9/2007 | Garman et al. | 211/188 |
| 2007/0227922 | A1 * | 10/2007 | Chappell et al. | 206/315.1 |
| 2007/0246491 | A1 * | 10/2007 | Shimura | 223/85 |
| 2007/0256457 | A1 * | 11/2007 | Kendall et al. | 68/3 R |

2007/0266740 A9* 11/2007 Kendall et al. ..... 68/3 R
2007/0266743 A9* 11/2007 Sunshine et al. ..... 68/13 R
2007/0283724 A9* 12/2007 Sunshine et al. ..... 68/3 R
2007/0290111 A1* 12/2007 Alonso ..... 248/316.7
2008/0009560 A1* 1/2008 McKay, Jr. ..... 523/102
2008/0022551 A1* 1/2008 Banta et al. ..... 34/602
2008/0047078 A1* 2/2008 Gully ..... 8/158
2008/0086980 A1* 4/2008 Martin ..... 52/750
2008/0113583 A1* 5/2008 Guzman et al. ..... 446/297
2008/0136295 A1* 6/2008 Aizpuru Borda et al. ..... 312/31
2008/0223677 A1* 9/2008 Mauro ..... 190/111
2008/0252189 A1* 10/2008 Regan ..... 312/249.8
2008/0256989 A1* 10/2008 Jeong et al. ..... 65/5 C
2008/0259615 A1* 10/2008 Chien ..... 362/382
2009/0045258 A1* 2/2009 Sabeta ..... 235/385
2009/0064593 A1* 3/2009 Ha ..... 49/400
2009/0078727 A1* 3/2009 Hassel et al. ..... 223/88
2009/0083989 A1* 4/2009 Wang ..... 34/442
2009/0090018 A1* 4/2009 Stein ..... 34/60

* cited by examiner

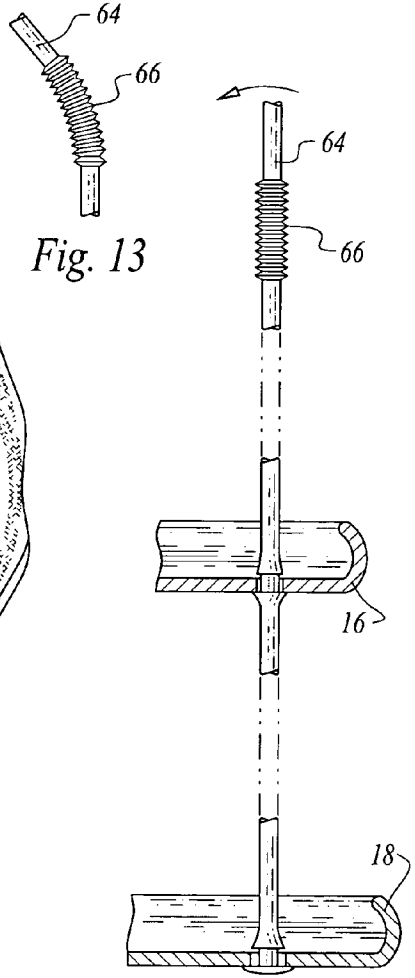
Fig. 12
Fig. 13
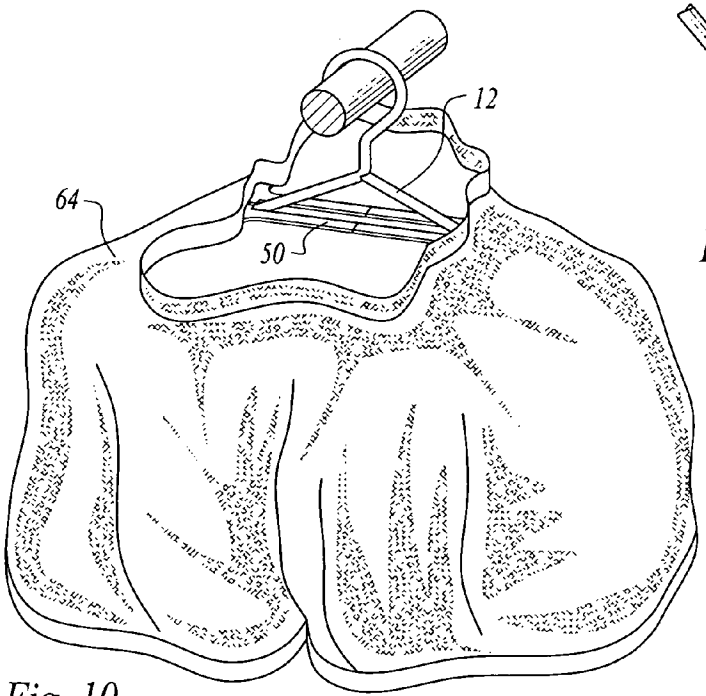
Fig. 10
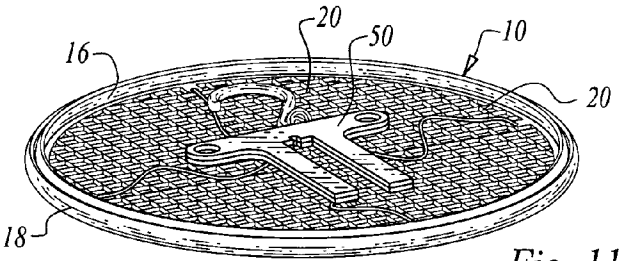
Fig. 11
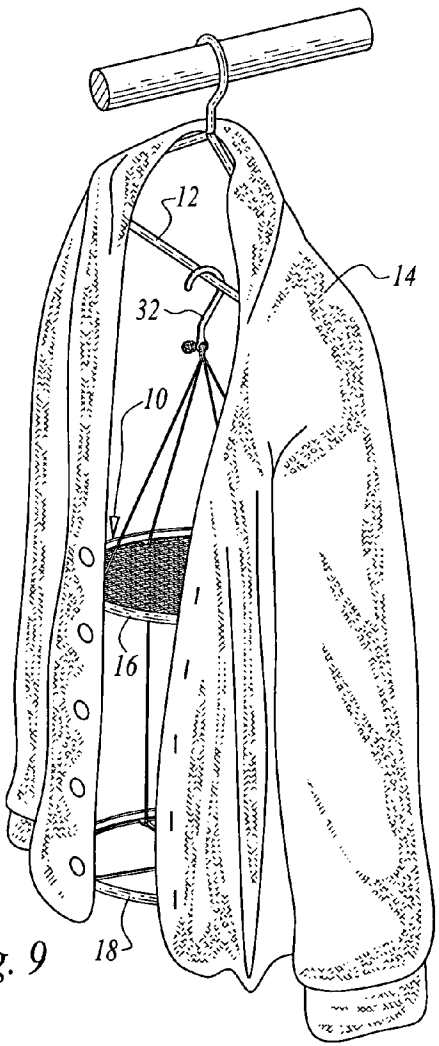
Fig. 9

CLOTHES DRYING APPARATUS

TECHNICAL FIELD

This invention relates to clothes drying apparatus, more particularly to a portable and collapsible clothes dryer which has particular, although not exclusive, application for use by travelers.

BACKGROUND OF THE INVENTION

Millions of people travel each year, many taking lengthy trips. They all require clean clothing, so they carry it with them. Clothing is bulky and relatively heavy. It is a particular and special burden on travelers who prefer to use only carry-on luggage as a way to avoid the delays and concerns of checked luggage.

As will be seen below, the apparatus of the present invention encompasses a clothes dryer kit especially suitable for transport in luggage, including carry-on luggage, and use throughout one's travels. A traveler has the option of washing and drying some clothing rather than carrying along extra clothing sets.

Wet clothing hung on a clothes line or hanger drys slowly, essentially only the outer surface of the clothing being directly exposed to ambient air.

There are many clothes drying devices known in the prior art but these have a number of deficiencies and do not readily lend themselves to luggage transport or to situations where relatively quick drying is required. Also, many known clothes drying constructions are relatively complex and expensive in addition to being relatively inefficient. The following prior art patent documents are believed to be representative of the current state of the prior art in this field: U.S. Pat. No. 6,922,911, issued Aug. 2, 2005, U.S. Pat. No. 3,477,155, issued Nov. 11, 1969, U.S. Pat. No. 5,607,088, issued Mar. 4, 1997, U.S. Pat. No. 3,486,669, issued Dec. 30, 1969, U.S. Pat. No. 3,464,604, issued Sep. 2, 1969, U.S. Pat. No. 2,929,538, issued Mar. 22, 1960, U.S. Pat. No. 2,777,618, issued Jan. 15, 1957, U.S. Pat. No. 2,539,895, issued Jan. 30, 1951, U.S. Pat. No. 2,060,395, issued Nov. 10, 1936, U.S. Pat. No. 3,750,917, issued Aug. 7, 1973, U.S. Pat. No. 4,915,271, issued Apr. 10, 1990, U.S. Pat. No. 5,394,621, issued Mar. 7, 1995, U.S. Pat. No. 5,163,590, issued Nov. 17, 1992, U.S. Pat. No. 2,117,656, issued May 17, 1938, U.S. Pat. No. 2,880,928, issued Apr. 7, 1959, U.S. Pat. No. 2,937,796, issued May 24, 1960, U.S. Pat. No. 5,950,882, issued Sep. 14, 1999, U.S. Pat. No. 3,675,338, issued Jul. 11, 1972, Japanese Publication No. JP2005323971, published Nov. 24, 2005, U.S. Pat. No. 2,902,192, issued Sep. 1, 1959, U.S. Pat. No. 4,613,066, issued Sep. 23, 1986, U.S. Pat. No. 2,108,308, issued Feb. 15, 1938, U.S. Pat. No. 2,958,447, issued Nov. 1, 1960, U.S. Pat. No. 3,645,425 issued Feb. 29, 1972 and U.S. Pat. No. 2,501,167, issued Mar. 21, 1950.

DISCLOSURE OF INVENTION

The apparatus of the present invention is compact and light-weight. Furthermore, it is sturdy, reusable and efficient. With the apparatus both the inner and outer surfaces of the article of clothing being dried are directly exposed to ambient air. Furthermore, the apparatus provides a channel for the air to circulate inside the wet clothing.

A faster and more reliable drying process as enabled by the apparatus of the present invention allows a traveler to wash some clothing in the evening and know that in all likelihood it will be dry and wearable in the morning, possibly even sooner.

The invention encompasses a portable collapsible clothes dryer kit including a first clothing article dryer unit for suspension from a coat hanger or other structural element and for facilitating drying of an article of clothing held by the first clothing article dryer unit. The first clothing article dryer unit includes first and second spacer members for spreading the article of clothing to expose the inner surface of an article of clothing to ambient air. The first clothing article dryer unit also includes a plurality of downwardly extending, spaced, elongated flexible elements.

Each of the spacer members includes a platform defining openings and a peripheral wall surrounding the platform.

The first and second spacer members depend from the plurality of spaced, elongated flexible elements and are spaced from one another when the first clothing article dryer unit is supported by a coat hanger or other structural element.

The first and second spacer members are selectively movable relative to one another and relative to the plurality of spaced, elongated flexible elements for placement into engagement with one another for compact storage when the first clothing article dryer unit is removed from the coat hanger or other structural element.

The portable collapsible clothes dryer kit also includes a second clothing article dryer unit for releasable connection to a coat hanger for support thereby to spread an article of clothing to expose the inner surface of the article of clothing to ambient air. The second clothing article dryer unit is selectively removable from the coat hanger for placement into engagement with at least one of the first and second spacer members and support thereby for compact storage.

Other features, advantages and objects of the present invention will become apparent with reference to the following description and accompanying drawings.

BRIEF DESCRIPTION OF DRAWINGS

FIG. 9 is a perspective view illustrating the first clothing article dryer unit depending from a coat hanger and exposing the inner surface of an article of clothing on the hanger to ambient air;

FIG. 10 is a perspective view illustrating the second clothing article dryer unit supported by a coat hanger and utilized to spread an article of clothing on the hanger so that the inner surface thereof is exposed to ambient air;

FIG. 11 is a view similar to FIG. 2, but showing the folded second clothing article dryer unit on a spacer member of the collapsed first clothing article dryer unit;

FIG. 12 is an enlarged, cross-sectional view illustrating an alternative embodiment of the first clothing article dryer unit wherein the elongated flexible element is in the form of a bendable flexible rod; and FIG. 13 is an elevational view of a flexible bendable joint of the alternative embodiment of second clothing article dryer unit.

MODES FOR CARRYING OUT THE INVENTION

Figure 1:
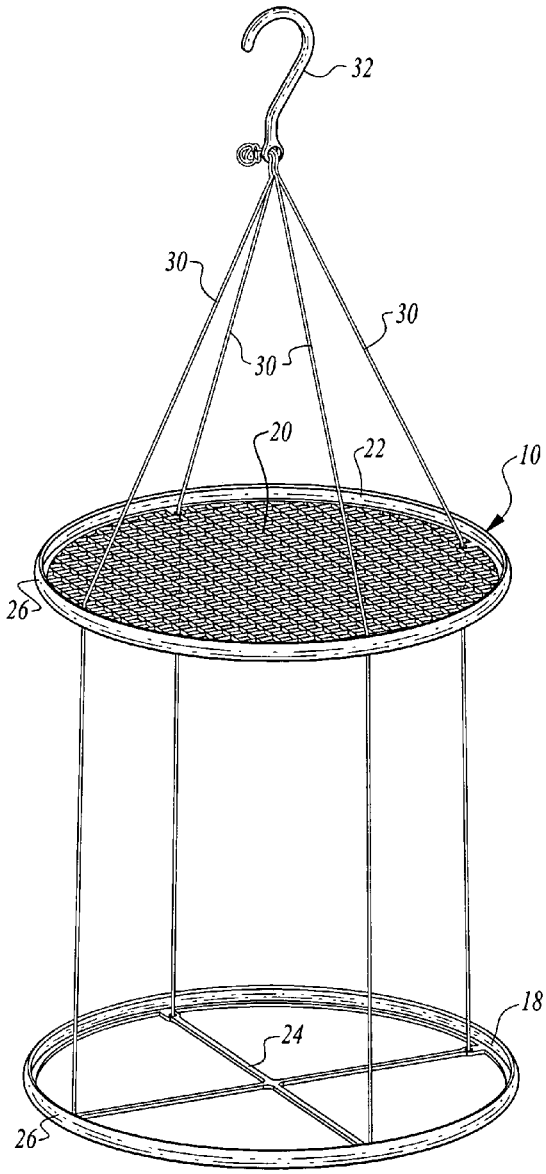
FIG. 1 is a perspective view of the first clothing article dryer unit of the invention in uncollapsed condition.

FIGS. 1-11 illustrate a preferred embodiment of this invention. The invention encompasses a portable collapsible dryer kit that has two clothing article dryer units or components. One is suitable, for example for T-shirts and other upper clothing and the other particularly suitable for shorts and other lower clothing. Both can be used with standard clothing hangers such as the flat or curved wood or plastic coat hangers or wire coat hangers. The two units can be employed separately or together.

The first clothing article dryer unit or component of the kit is designated by reference numeral 10. The unit 10 is for suspension from a coat hanger 12 (see FIG. 9) or it could be supported from any other suitable structural element.

First clothing article dryer unit 10 is for the purpose of facilitating drying of an article of clothing held thereby. For example, FIG. 9 shows the first clothing article dryer unit supporting and spreading a shirt 14 to form a top to bottom inner air channel therein and directly expose the inner surface of the shirt to ambient air.

Unit 10 includes an upper spacer member 16 and a lower spacer member 18. The spacer members are suitably formed of thin, light-weight material such as plastic. The disclosed spacer members are circular or ring shaped. Spacer member 16 has a platform 20 defining a plurality of holes to allow air to pass through the platform. Spacer member 16 includes a peripheral wall 22 surrounding the platform 20 and extending laterally upwardly therefrom.

Figure 4:
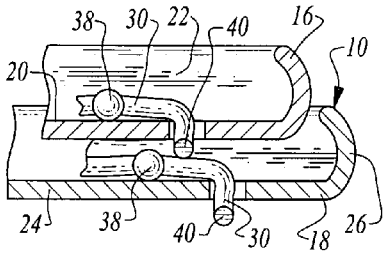
FIG. 4 is a greatly enlarged view in cross-section of the portion of the collapsed first clothing article dryer unit designated by arrows 4-4 in FIG. 2.
Figure 2:
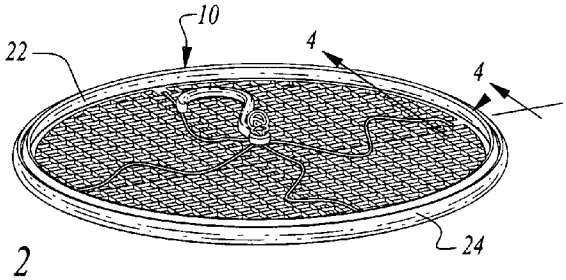
FIG. 2 is a perspective view of the first clothing dryer unit in collapsed condition, suitable for transport and storage.
Figure 5:
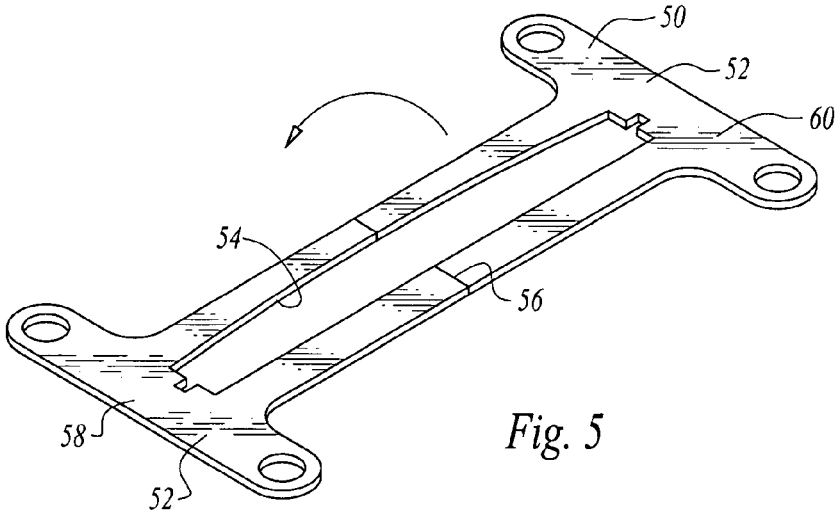
FIG. 5 is a perspective view of a second clothing article dryer unit employed in the portable collapsible clothes dryer kit of the invention.

Spacer member 18 includes a platform 24 defining four large openings. A peripheral wall 26 surrounds the platform 24 and extends laterally upwardly therefrom, as illustrated. The outer diameter of peripheral wall 22 is less than the diameter of peripheral wall 26. This allows the spacer members to nest when first clothing article dryer unit 10 is in collapsed condition as illustrated in FIGS. 2 and 4.

Figure 3:
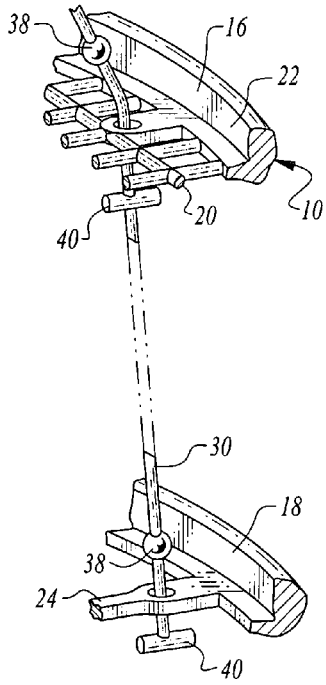
FIG. 3 is an enlarged, perspective view illustrating portions of the first and second spacer members of the first clothing article dryer unit and a portion of an elongated flexible element cooperable therewith.

When in use, the first clothing article dryer unit is in the non-collapsed or extended position shown in FIGS. 1, 3 and 9. The spacer members 16, 18 depend from a plurality of spaced, elongated flexible elements in the form of cords 30 which may be of any suitable material such as nylon. The cords 30 extend downwardly from an upper location wherein the cord ends are attached to a support hook 32. From the support hook the cords diverge and pass through the platform 20 at or near the outer periphery thereof. From spacer member 16 the cords extend downwardly to spacer member 18, terminating at or near the outer periphery of that lower spacer member.

Each cord 30 has affixed thereto at spaced locations thereon two pairs of protrusions 38, 40. These protrusions serve to support and maintain the first and second spacer members in spaced relationship at preselected locations along the cords 30.

Figure 6:
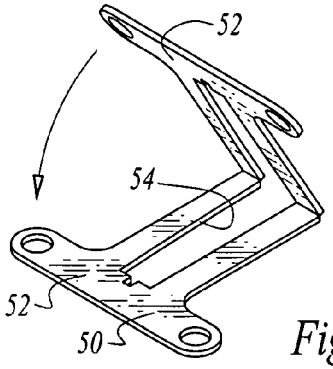
FIG. 6 is a perspective view of the second clothing article dryer unit being folded for transport and storage.
Figure 7:
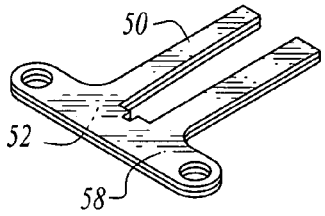
FIG. 7 is a perspective view of the second clothing article dryer unit completely folded.
Figure 8:
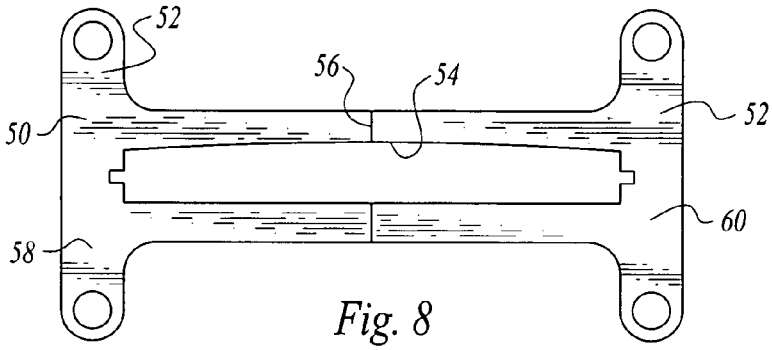
FIG. 8 is a top, plan view of the second clothing article dryer unit in its unfolded condition as shown in FIG. 5.

Referring now to FIGS. 5-8, 10 and 11, another component of the portable collapsible clothes dryer kit, a second clothing article dryer unit 50, is shown. Unit 50 is particularly suitable for drying shorts and other lower clothing. The unit 50 is in the form of an elongated substantially flat panel having enlarged ends 52 and defining an elongated opening 54. The unit 50 is suitably formed of plastic and incorporates a hinge, for example a live hinge 56, which divides the unit 50 into two panel segments 58, 60. When not in use, the panel may be folded about hinge 56 as shown in FIG. 6 to produce the folded configuration shown in FIG. 7. FIG. 10 shows the panel on a coat hanger 12, the elongated opening 54 receiving the upper portion of the coat hanger and the portion of the coat hanger below the panel in engagement therewith and supporting the panel. FIG. 10 illustrates a pair of shorts 64 held by the unit 50, the unit spreading the shorts to expose the inner surface thereof to ambient air and at the same time creating an air channel from top to bottom of the shorts. When not in use and when the unit 10 is collapsed, the folded second clothing article dryer unit 50 may be placed into engagement with and supported by the platform 20 of spacer member 18 as shown in FIG. 11 to form a compact travel or storage kit configuration.

FIGS. 12 and 13 illustrate another embodiment of the invention wherein the spaced, elongated flexible elements 64 are in the form of flexible rods, for example plastic rods, connected at their upper ends to a support hook (not shown in this Fig.) such as support hook 32. In the arrangement illustrated, the protrusions utilized to hold the spacer members are integrally molded on the flexible rod. The rods include accordion-type bendable joints 66 facilitating bending thereof.

The invention claimed is:

1. A portable collapsible clothes dryer kit comprising, in combination:

a first clothing article dryer unit for suspension from a coat hanger or other structural element and for facilitating drying of an article of clothing held by said first clothing article dryer unit, said first clothing article dryer unit including first and second spacer members for spreading the article of clothing to expose the inner surface of an article of clothing to ambient air and a plurality of downwardly extending, spaced, elongated flexible elements, each of said spacer members including a platform defining openings and an upwardly extending peripheral wall surrounding the platform, said first and second spacer members depending from said plurality of spaced, elongated flexible elements and spaced from one another when said first clothing article dryer unit is supported by a coat hanger or other structural element, said first and second spacer members being selectively movable relative to one another and relative to said plurality of spaced, elongated flexible elements for placement into engagement with one another for compact storage when said first clothing article dryer unit is removed from said coat hanger or other structural element, each of said spaced, elongated flexible elements passing through the platforms of both of said spacer members within the confines of the peripheral walls surrounding said platforms;

first and second pairs of protrusions at spaced locations on each of said spaced, elongated flexible elements, said first spacer member being located between and engageable by the protrusions of said first pair of protrusions and said second spacer member being located between and engageable by the protrusions of said second pair of protrusions to maintain said spacer members spaced from one another on said spaced, elongated flexible elements with said spacer members forming an open-ended top to bottom inner air channel within an article of clothing held by said first clothing article drying unit to directly expose the inner surface of the article of clothing to ambient air, said holes in said platforms allowing for the passage of air through said platforms along said open-ended top to bottom inner air channel, said first clothing article dryer unit including a support to which said spaced, elongated flexible elements are connected and from which said spaced, elongated flexible elements depend, the outer diameter of the peripheral wall of said first spacer member being smaller than the outer diameter of the peripheral wall of said second spacer member whereby said first spacer member can be positioned on the platform of said second spacer member and nested within the confines of the peripheral wall of said second spacer member along with portions of said spaced, elongated flexible elements and said support located on the platform of said first spacer member; and a second clothing article dryer unit for releasable connection to a coat hanger for support thereby to spread an article of clothing to expose the inner surface of the article of clothing to ambient air, said second clothing article dryer unit being selectively removable from said coat hanger for placement into engagement with at least one of said first and second spacer members and support thereby for compact storage.

2. The portable collapsible clothes dryer kit according to claim 1 wherein said support comprises a hook.

3. The portable collapsible clothes dryer kit according to claim 1 wherein said spaced, elongated flexible elements comprise cords.

4. The portable collapsible clothes dryer kit according to claim 1 wherein the peripheral walls of said first and second spacer members are substantially circular and wherein the platforms thereof are flat.

5. The portable collapsible clothes dryer kit according to claim 1 wherein said elongated flexible elements comprise flexible rods.

6. The portable collapsible clothes dryer kit according to claim 1 wherein said second clothing article dryer unit comprises an elongated substantially flat panel having enlarged ends and defining an elongated opening for receiving the upper portion of a coat hanger with the portion of said coat hanger below said panel in engagement therewith and supporting said panel, said enlarged ends for spreading out an article of clothing placed over said panel and said coat hanger to facilitate drying of the article of clothing.

7. The portable collapsible clothes dryer kit according to claim 6 wherein said panel is comprised of a plurality of hingedly connected panel segments enabling folding of said panel.

8. A portable collapsible clothing article dryer unit for suspension from a coat hanger or other structural element and for facilitating drying of an article of clothing held by said clothing article dryer unit, said clothing article dryer unit including first and second spacer members for spreading the article of clothing to expose the inner surface of the article of clothing to ambient air and a plurality of downwardly extending, spaced, elongated flexible elements, each of said spacer members including a platform defining openings and an upwardly extending peripheral wall surrounding the platform, said first and second spacer members depending from said plurality of spaced, elongated flexible elements and spaced from one another when said clothing article dryer unit is supported by a coat hanger or other structural element, said first and second spacer members being selectively movable relative to one another and relative to said plurality of spaced, elongated flexible elements for placement into engagement with one another for compact storage when said clothing article dryer unit is removed from said coat hanger or other structural element each of said spaced, elongated flexible elements passing through the platforms of both of said spacer members within the confines of the peripheral walls surrounding said platforms;

first and second pairs of protrusions at spaced locations on each of said spaced, elongated flexible elements, said first spacer member being located between and engageable by the protrusions of said first pair of protrusions and said second spacer member being located between and engageable by the protrusions of said second pair of protrusions to maintain said spacer members spaced from one another on said spaced, elongated flexible elements with said spacer members forming an open-ended top to bottom inner air channel within an article of clothing held by said first clothing article drying unit to directly expose the inner surface of the article of clothing to ambient air, said holes in said platforms allowing for the passage of air through said platforms along said open-ended top to bottom inner air channel, said first clothing article dryer unit including a support to which said spaced, elongated flexible elements are connected and from which said spaced, elongated flexible elements depend, the outer diameter of the peripheral wall of said first spacer member being smaller than the outer diameter of the peripheral wall of said second spacer member whereby said first spacer member can be positioned on the platform of said second spacer member and nested within the confines of the peripheral wall of said second spacer member along with portions of said spaced, elongated flexible elements and said support located on the platform of said first spacer member.

9. The portable collapsible clothing article dryer unit according to claim 8 wherein said support comprises a hook.

10. The portable collapsible clothing article dryer unit according to claim 8 wherein said spaced, elongated flexible elements comprise cords.

11. The portable collapsible clothing article dryer unit according to claim 8 wherein the peripheral walls of said first and second spacer members are substantially circular and wherein the platforms thereof are flat.

12. The portable collapsible clothing article dryer unit according to claim 8 wherein said elongated flexible elements comprise flexible rods.

13. A clothing article dryer unit comprising an elongated, substantially flat, substantially straight panel formed of substantially rigid material having enlarged ends and defining an elongated opening for receiving the upper portion of a coat hanger with the portion of said coat hanger below said panel in engagement therewith and supporting said panel with the enlarged ends spaced from and disposed over the coat hanger, said enlarged ends for engaging and spreading out an article of clothing placed over said panel and said coat hanger to maintain said article of clothing substantially away from said coat hanger to provide an air passage and expose the inner surface of the article of clothing to ambient air to facilitate drying of the article of clothing.

14. The portable collapsible clothing article dryer unit according to claim 13 wherein said panel is comprised of a plurality of hingedly connected panel segments enabling folding of said panel to place said hingedly connected panel segments in face to face relationship.

* * * * *